US009918505B2

(12) United States Patent
Dorn

(10) Patent No.: US 9,918,505 B2
(45) Date of Patent: Mar. 20, 2018

(54) GARMENTS HAVING A POCKET DESIGNED WITH A MICROFIBER DRYING PANEL

(71) Applicant: Paul Dorn, Atlanta, GA (US)

(72) Inventor: Paul Dorn, Atlanta, GA (US)

( * ) Notice: Subject to any disclaimer, the term of this patent is extended or adjusted under 35 U.S.C. 154(b) by 132 days.

(21) Appl. No.: 14/969,401

(22) Filed: Dec. 15, 2015

(65) Prior Publication Data

US 2016/0165981 A1 Jun. 16, 2016

Related U.S. Application Data

(60) Provisional application No. 62/092,210, filed on Dec. 15, 2014.

(51) Int. Cl.

| | |
|---|---|
| ***A41D 27/20*** | (2006.01) |
| ***A63B 57/00*** | (2015.01) |
| *A41D 27/00* | (2006.01) |

(52) U.S. Cl.

CPC ..... *A41D 27/208* (2013.01); *A63B 57/00* (2013.01)

(58) Field of Classification Search

CPC . A63B 57/60; A63B 55/408; A63B 2047/043; A41D 27/20; A41D 1/08; A41D 2400/48; A41D 2600/10; A41D 27/12; A47K 10/02; A45F 5/04; A47L 13/16

See application file for complete search history.

(56) References Cited

U.S. PATENT DOCUMENTS

| | | | | | |
|---|---|---|---|---|---|
| 2,530,746 | A * | 11/1950 | Wetherby | A63B 47/04 | 15/104.002 |
| 3,242,502 | A * | 3/1966 | Geist | A41D 27/20 | 2/253 |
| 4,768,236 | A * | 9/1988 | Klob | A41D 13/0015 | 2/115 |
| 5,724,698 | A * | 3/1998 | Mondragon | A47K 10/02 | 15/209.1 |
| 5,893,190 | A * | 4/1999 | Mertz | A45B 3/00 | 15/209.1 |
| 6,258,455 | B1 * | 7/2001 | Clarke | A01N 25/34 | 428/392 |

(Continued)

FOREIGN PATENT DOCUMENTS

| | | |
|---|---|---|
| CN | 203195579 U | 9/2013 |
| WO | 2013-109150 | 7/2013 |

OTHER PUBLICATIONS

The Written Opinion and ISR of the ISA dated Jul. 12, 2016 issued in the corresponding PCT/US2015/065915 filed Dec. 15, 2015.

(Continued)

*Primary Examiner* — Bobby Muromoto, Jr.
(74) *Attorney, Agent, or Firm* — Minh N. Nguyen; Benjamin A. Balser; Next IP Law Group, LLC

(57) ABSTRACT

Garments having a pocket designed with a microfiber drying panel are provided. A representative garment includes a garment material, a body section that is made of the garment material and covers a body, at least one limb section that is made of the garment material and covers a limb of the body, and a pocket section that is located at either the body section and the at least one limb section. The pocket section includes a slit section on the garment material. A top portion of the slit section is attached to a top portion of a microfiber drying panel.

16 Claims, 6 Drawing Sheets

(56) References Cited

U.S. PATENT DOCUMENTS

| | | | | |
|---|---|---|---|---|
| 2003/0068481 | A1* | 4/2003 | Kody | B32B 5/02 428/292.1 |
| 2005/0144704 | A1* | 7/2005 | Vitallo | A41D 27/20 2/247 |
| 2006/0059644 | A1* | 3/2006 | Steele | A63B 47/04 15/210.1 |
| 2007/0226934 | A1* | 10/2007 | Bohannon | A45F 5/04 15/209.1 |
| 2008/0135668 | A1* | 6/2008 | McCoy | A47K 10/28 242/538.1 |
| 2009/0031517 | A1* | 2/2009 | Hollows | A63B 47/04 15/210.1 |
| 2010/0199451 | A1* | 8/2010 | Taylor | A63B 47/04 15/210.1 |
| 2011/0314592 | A1* | 12/2011 | Wells-Chubb | A41D 27/20 2/247 |
| 2014/0259292 | A1* | 9/2014 | Santamaria | A63B 57/0087 2/227 |

OTHER PUBLICATIONS

PROACTIVESPORTSGROUP, Green-Go. Youtube. Sep. 22, 2010, Retrieved from the internet: URL: https://www.youtube.com/watch? v=5BNR3XcUnFI entire video.

* cited by examiner

GARMENTS HAVING A POCKET DESIGNED WITH A MICROFIBER DRYING PANEL

CROSS REFERENCE TO RELATED APPLICATIONS

This application claims the benefit of U.S. provisional application entitled, "Towel Pocket Pant," having Ser. No. 62/092,210, filed on Dec. 15, 2014, all of which are entirely incorporated herein by reference.

TECHNICAL FIELD

The present disclosure is generally related to garments and, more particularly, is related to garments having a pocket designed with a microfiber drying panel.

BACKGROUND

Most often golfers (or players of any sport) have few means to keep hands and equipment clean during play, other than a separate towel. Desirable in the art is an improved pocket on a garment that would improve upon the conventional pocket on the garment.

SUMMARY

Garments having a pocket designed with a microfiber drying panel are provided. A representative garment includes a garment material, a body section that is made of the garment material and covers a body, at least one limb section that is made of the garment material and covers a limb of the body, and a pocket section that is located at either the body section and the at least one limb section. The pocket section includes a slit section on the garment material. A top portion of the slit section is attached to a top portion of a microfiber drying panel.

Other apparatuses, methods, features of the invention will be or will become apparent to one skilled in the art upon examination of the following figures and detailed description. It is intended that all such apparatuses, methods, features be included within the scope of the invention, and be protected by the accompanying claims.

BRIEF DESCRIPTION OF DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, the reference numerals designate corresponding parts throughout the several views. While several embodiments are described in connection with these drawings, there is no intent to limit the disclosure to the embodiment or embodiments disclosed herein. On the contrary, the intent is to cover all alternatives, modifications, and equivalents.

DETAILED DESCRIPTION

Exemplary apparatuses are discussed with reference to the figures. Although these apparatuses are described in detail, they are provided for purposes of illustration only and various modifications are feasible.

The pocket designed with the microfiber drying panel can be attached on any type of garments, such as shorts, skirts, pants, shirts, jackets, dresses, etc. The pocket designed with the microfiber drying panel aids in the performance of a player by keeping hands, grips, clubs, balls, or any instrument dry and clean while engaged in play or activity. Incorporating a specialized towel uniquely suited for quick drying and cleaning into a garment solves the often frequent need for keeping hands and equipment dry and clean at a moments notice (usually, before a shot, swing, tossing a fishing line, handling a tool, etc). The pocket designed with the microfiber drying panel gives the user an added performance edge, by keeping hands and instruments clean and dry at all times and without distraction. There are multiple embodiments of the pocket designed with the microfiber drying panel that will be described below. MicroFiber is a man-made product that combines two basic fibers, Polyester and Polyamide, producing fibers with a thickness less than a human hair that have been split many times into a "V" shape. The fibers are then woven into fabric of Polyester (e.g., the scrubbing and cleaning fiber), and Polyamide (e.g, the absorbing and quick drying fiber).

Figure 1:
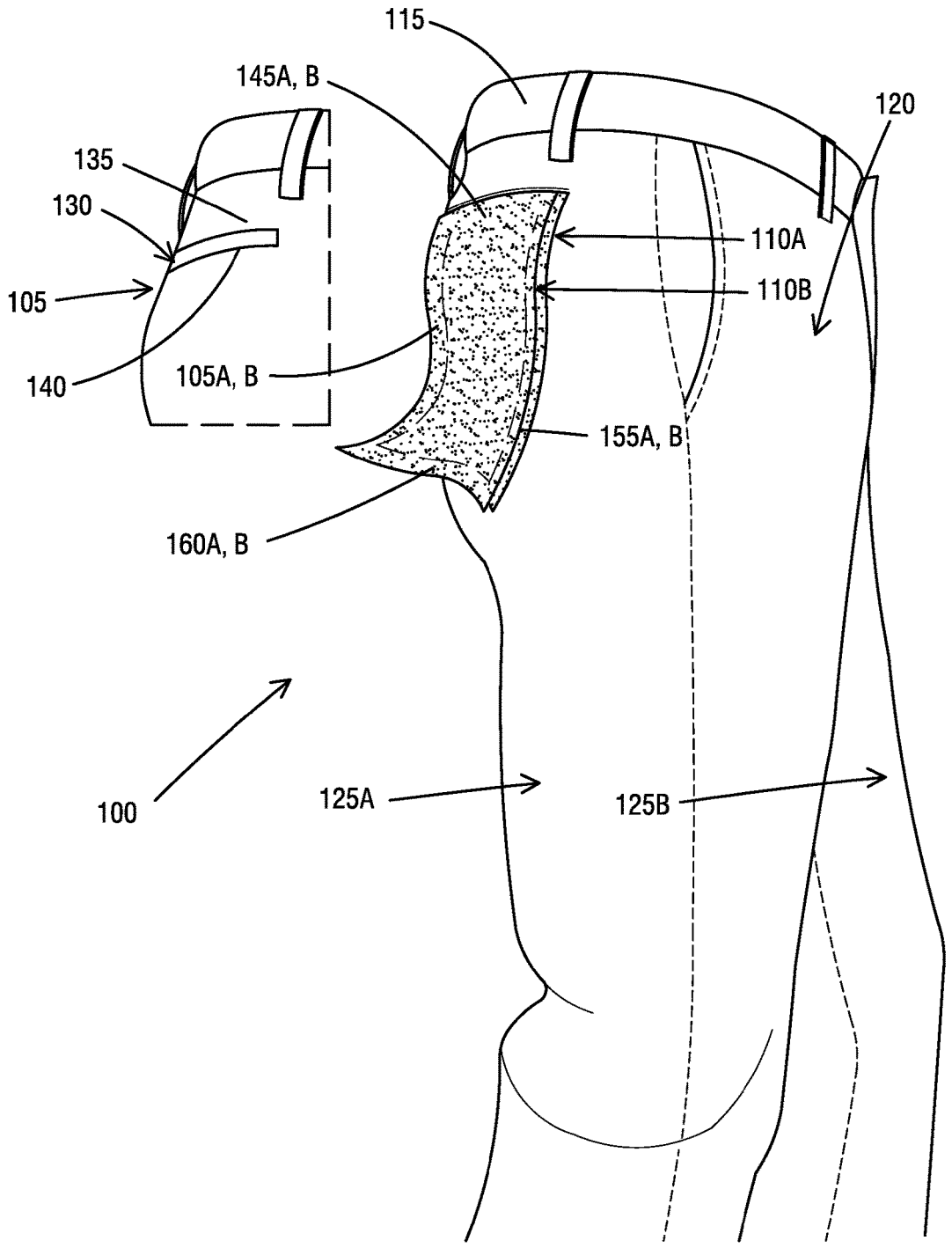
FIG. 1 is a garment that illustrates an embodiment of a pocket designed with a microfiber drying panel.

FIG. 1 is a garment 100 that illustrates an embodiment of a pocket 105 designed with a microfiber drying panel 110. In this example, the garment 100 is a pant. The garment 100 includes a garment material 115, a body section 120 that is made of the garment material 115 and covers a body (e.g., waist and buttock area), two limb sections 125A, B that are made of the garment material 115 and cover the legs, and a pocket section 105 that is located at the body section 120. The pocket section 105 includes a slit section 130 on the garment material. A top portion 135 of the slit section 130 is attached to a top portion 145A of a first microfiber drying panel 110A.

A bottom portion 140 of the slit section 130 is attached to a top portion 145B of a second microfiber drying panel 110B. The left, right and bottom portions 150A, B, 155A, B, 160A, B of the microfiber drying panels 110A,B are attached to form a pocket 105.

The pant 100 in FIG. 1 has a large and deep pocket that is made of high-absorbency split-micro fiber 110A, B designed specifically for drying and cleaning. The user can insert and dry their hands within the pocket 105, or pull the pocket 105 inside out and let it hang outside the pant, in order to dry and/or clean, wipe hands, grips, balls, clubs, racquets, bats or instruments. The microfiber pocket 105 can hang inside out, until user wishes to conceal it. This pocket 105 can be located anywhere on the pant 100, but is recommended to be placed above the back pocket 105 for golf or racquet sports or any activities.

The pocket 105 in FIG. 1 can be constructed, for example, by joining two 7.5"W×12"L sections (or any variation) as the rear and front microfiber panels 110A, B using by way of pocket stitching Additionally or alternatively, the pocket 105 can be constructed by sewing or joining a single 15"W×12"L piece of same material at opposite horizontal ends, in order to make a sock-tube that can be closed at the bottom, or not open at the bottom, or closed by Velcro, or cinching cord. The pocket material type is designed for high absorbency and cleaning ability and breathability. The pocket material and the towel material are one in the same.

Figure 2:
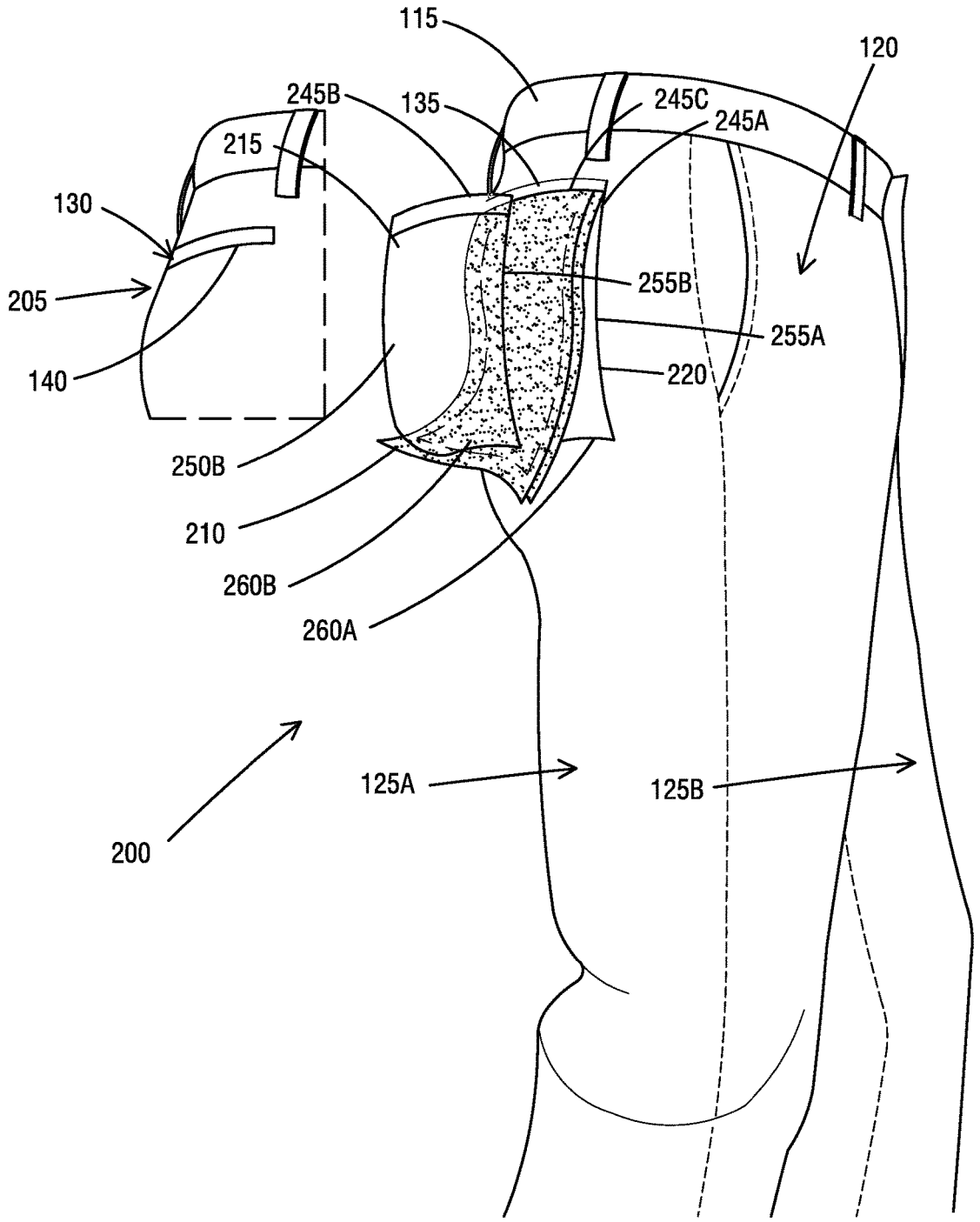
FIG. 2 is a garment that illustrates another embodiment of a pocket designed with a microfiber drying panel.

FIG. 2 is a garment 200 that illustrates another embodiment of a pocket 205 designed with a microfiber drying panel 210. In this example, the structure and design of the garment 200 of FIG. 2 is similar to the structure and design of the garment 100 as described in FIG. 1. Like features are labeled with the same reference numbers, such as the garment material 115, body section 120, limb sections 125A, B, slit section 130, and top and bottom portions 135, 140 of the slit section 130.

The garment 200 further includes a front moisture resistant panel 215 and a rear moisture resistant panel 220 in which the bottom portion 140 and top portion 135 of the slit section 130 are attached to respective top portions 245A, C of the rear moisture resistant panel 220 and the microfiber drying panel 210 and top portion 245B of the front moisture resistant panel 215. The left, right and bottom portions 250A,B, 255A, B, 260A,B of the front and rear moisture resistant panels 215, 220 are attached to form a pocket. The microfiber drying panel 210 is positioned between the front and rear moisture resistant panels 215, 220 and hangs freely within the pocket 205.

The front and rear moisture resistant panels 215, 220 can be made of either stretchable, water and oil resistant fabric, e.g. Nylon Lycra, or a two sided light nylon coated cotton rain material. The microfiber drying panel 210 can be made of a high absorbency split micro-fiber towel and can be pulled out, manipulated, hung outside of the pocket 205, and be concealed inside of the pocket 205.

Figure 3:
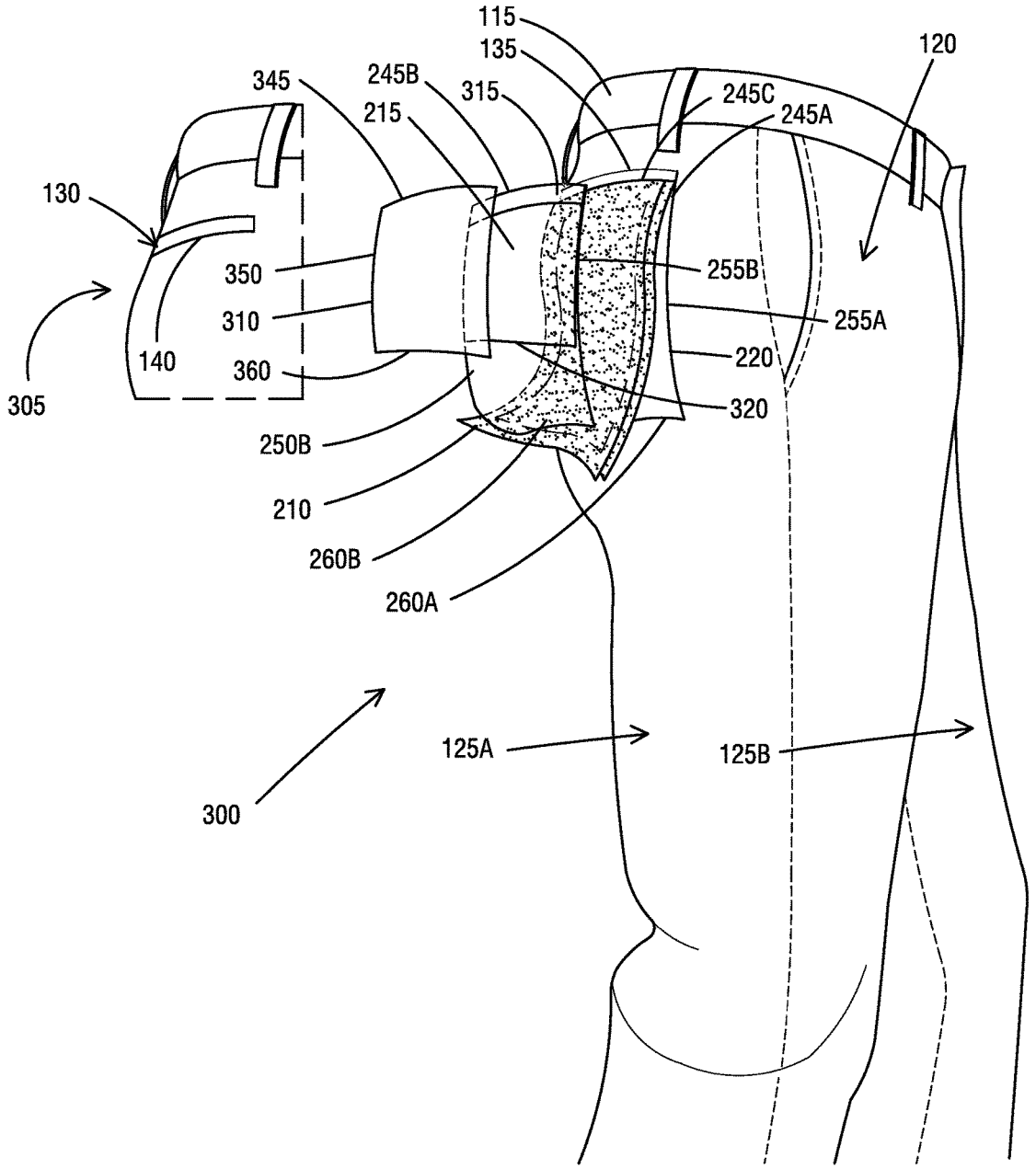
FIG. 3 is a garment that illustrates another embodiment of a pocket designed with a microfiber drying panel.

FIG. 3 is a garment 300 that illustrates another embodiment of a pocket 305 designed with a microfiber drying panel 210. In this example, the structure and design of the garment 300 of FIG. 3 is similar to the structure and design of the garment 200 as described in FIG. 2. Like features are labeled with the same reference numbers, such as the garment material 115, body section 120, limb sections 125A, B, slit section 130, top and bottom portions 135, 140 of the slit section 130, microfiber drying panel 210, front moist resistant panel 215, and rear moist resistant panel 220.

The garment 300 further includes a front pocket panel 310 in which a bottom portion 140 of the slit section 130 is attached to a top portion 345 of the front pocket panel 310. The left, right and bottom portions 350, 355, 360 of the front pocket panel 310 are attached to the front moisture resistant panel 215 at outline 320 to form a traditional pocket. In this example, the top portion 245B of the front moisture resistant panel 215 is attached with an elastic band/fabric 315 such that the front moisture resistant panel 215, microfiber drying panel 210, and rear moisture resistant panel 220 form a pullout pocket. The elastic band/fabric 315 can be a Nylon Lycra, for example.

The garment 300 has the pullout pocket and the traditional pocket, such that when a user inserts his/her hand, the user finds the traditional pocket, but when the user tugs on the elastic band 315 on the top of the front moisture resistant panel 215 the user can access the microfiber drying panel 210 in the pullout pocket. The microfiber drying panel 210 can made of split micro fiber towel material. This towel can be accessed and used within the pocket or can be pulled outside of the pocket to hang outside of pant. The pocket 305 can be stitched per traditional pocket stitching.

Figure 4:
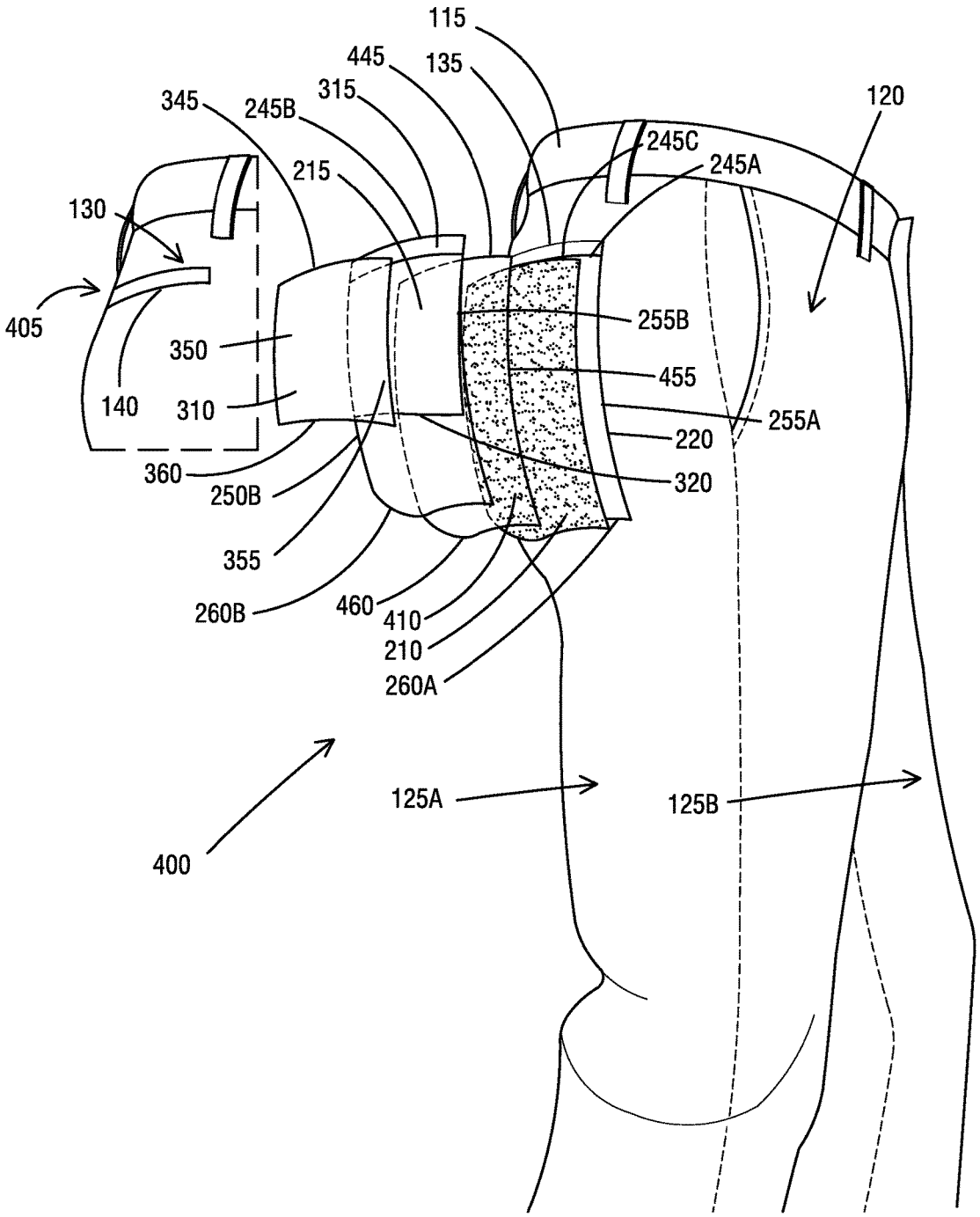
FIG. 4 is a garment that illustrates another embodiment of a pocket designed with a microfiber drying panel.

FIG. 4 is a garment 400 that illustrates another embodiment of a pocket 405 designed with a microfiber drying panel 210. In this example, the structure and design of the garment 400 of FIG. 4 is similar to the structure and design of the garment 300 as described in FIG. 3. Like features are labeled with the same reference numbers, such as the garment material 115, body section 120, limb sections 125A, B, slit section 130, top and bottom portions 135, 140 of the slit section 130, microfiber drying panel 210, front moist resistant panel 215, rear moist resistant panel 220, and front pocket panel 310.

The garment 400 further includes another microfiber drying panel 410 in which the top portion 245B of the front moisture resistant panel 215 is attached to a top portion 445 of the another microfiber drying panel 410. The left, right and bottom portions 150, 450, 155, 455, 160, 460 of the microfiber drying panels 110, 410 are attached to form a towel pocket. The microfiber drying panels 110, 410 are positioned between the rear and front moisture resistant panels 215, 220.

Figure 5:
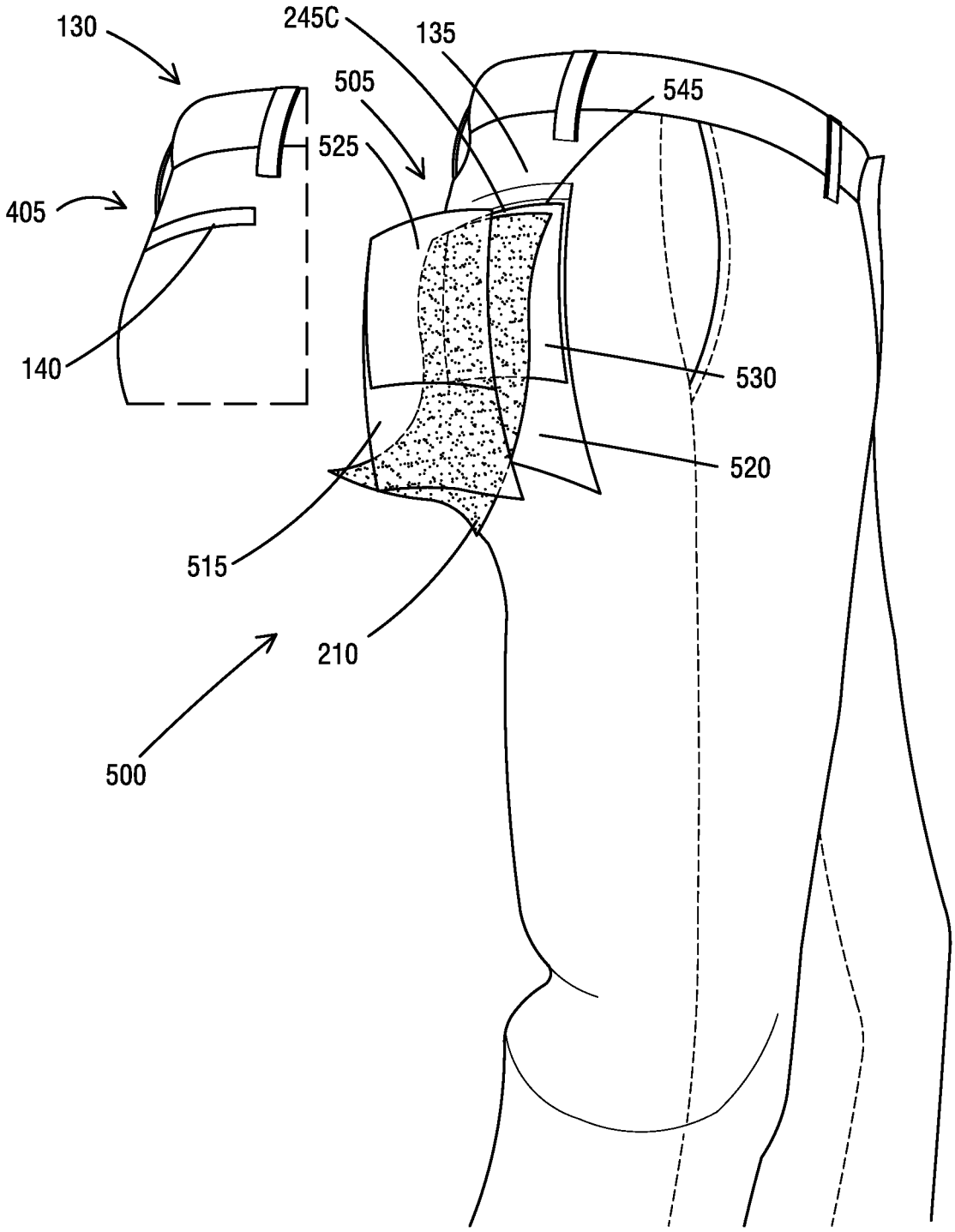
FIG. 5 is a garment that illustrates another embodiment of a pocket converting kit designed with a microfiber drying panel.

FIG. 5 is a garment 500 that illustrates another embodiment of a pocket converting kit 505 designed with a microfiber drying panel 210. The garment 500 includes front and rear attachable panels 525, 530 that include adhesive on outer surfaces of the attachable panels 525, 530. The outer surfaces of the attachable panels 525, 530 attach to the respective inner surfaces of front and rear pocket panels 515, 520 via the adhesive. The top portion 245C of the microfiber drying panel 210 is attached to a top portion 545 of the rear attachable panel 530.

The pocket converting kit 505 is a kit for converting any pocket on any garment into a pocket having a microfiber drying panel 210. The front and rear attachable panels 525, 530 can be made of iron-on material with their adhesive sides on the outside and facing away from each other. A heating iron can be use to apply heat to the attachable panels 525, 530 from the inner surface of the attachable panels 525, 530, resulting in a bonding the attachable panels 525, 530 to the respective pocket panels 515, 520. Additionally and/or alternatively, the front and rear attachable panels 525, 530 can be stitched to the respective front and rear pocket panels 515, 520, which be made of standard pocket wall materials. Additionally and/or alternatively, the left and right portions of the front and rear attachable panels can be attached together.

Figure 6:
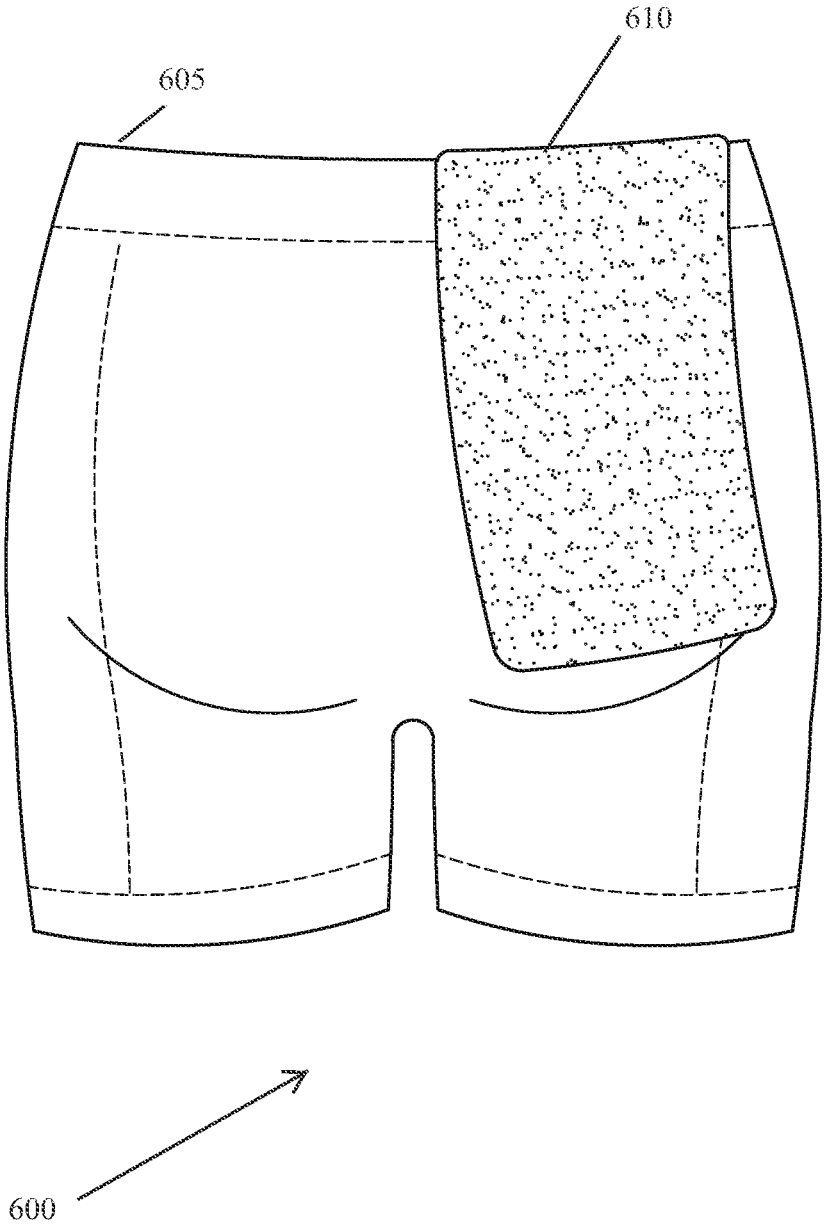
FIG. 6 is an undergarment having a microfiber drying panel in accordance with an embodiment of the invention.

FIG. 6 is an undergarment 600 having a microfiber drying panel 610 in accordance with an embodiment of the invention. The undergarment 600 can include, but not limited to, woman's panties, woman's underpants, woman's spandex, men's underwear, men's boxer shorts and boxer briefs, etc. A waist section 605 of the undergarment 600 is attached to a top portion of the microfiber drying panel 610. The microfiber drying panel 610 can be attached at either the inner or outer surface of the undergarment 600. The microfiber drying panel 610 hangs freely between the undergarment 600 and a garment 100, 200, 300, 400, 500, such as that described above, and/or outside of the garment 100, 200, 300, 400, 500.

This description has been presented for purposes of illustration and description. It is not intended to be exhaustive or to limit the disclosure to the precise forms disclosed. Obvious modifications or variations are possible in light of the above teachings. The embodiments discussed, however, were chosen to illustrate the principles of the disclosure, and its practical application. The disclosure is thus intended to enable one of ordinary skill in the art to use the disclosure, in various embodiments and with various modifications, as are suited to the particular use contemplated. All such modifications and variation are within the scope of this disclosure, as determined by the appended claims when interpreted in accordance with the breadth to which they are fairly and legally entitled.

Therefore, having thus described the disclosure, at least the following is claimed:

1. A garment comprising:

a garment material;

a body section that is made of the garment material and covers a body;

at least one limb section that is made of the garment material and covers a limb of the body;

a pocket section that is located at either the body section and the at least one limb section; wherein the pocket section includes a slit section on the garment material, wherein a top portion of the slit section is attached to a top portion of a microfiber drying panel;

a front moisture resistant panel and a rear moisture resistant panel in which the top portion of the slit section is attached to a top portion of the rear moisture resistant panel, wherein the left, right and bottom portions of the rear and front moisture resistant panels are attached to form a pocket, wherein the microfiber drying panel is positioned between the rear and front moisture resistant panels and hangs freely within the pocket; and another microfiber drying panel in which a top portion of the front moisture resistant panel is attached to a top portion of the another microfiber drying panel, wherein the left, right and bottom portions of the microfiber drying panels are attached to form a towel pocket, wherein the microfiber drying panels are positioned between the rear and front moisture resistant panels.

2. The garment as defined in claim 1, wherein a bottom portion of the slit section is attached to a top portion of another microfiber drying panel, wherein the left, right and bottom portions of the microfiber drying panels are attached to form a pocket.

3. The garment as defined in claim 2, wherein the bottom portions of the microfiber drying panels are attached by way of Velcro or cinching cord.

4. The garment as defined in claim 1, wherein the microfiber drying panel is designed for high absorbency and cleaning ability and breathability.

5. The garment as defined in claim 1, further comprising a front moisture resistant panel and a rear moisture resistant panel in which the top portion and a bottom portion of the slit section are attached to respective top portions of the rear and front moisture resistant panels, wherein the left, right and bottom portions of the rear and front moisture resistant panels are attached to form a pocket, wherein the microfiber drying panel are positioned between the rear and front moisture resistant panels and hangs freely within the pocket.

6. The garment as defined in claim 5, wherein the rear and front moisture resistant panels is made of either stretchable water and oil resistant fabric or two-sided light nylon coated cotton rain material.

7. A garment comprising:

a garment material;

a body section that is made of the garment material and covers a body;

at least one limb section that is made of the garment material and covers a limb of the body;

a pocket section that is located at either the body section and the at least one limb section; wherein the pocket section includes a slit section on the garment material, wherein a top portion of the slit section is attached to a top portion of a microfiber drying panel;

a front moisture resistant panel and a rear moisture resistant panel in which the top portion of the slit section is attached to a top portion of the rear moisture resistant panel, wherein the left, right and bottom portions of the rear and front moisture resistant panels are attached to form a pocket, wherein the microfiber drying panel is positioned between the rear and front moisture resistant panels and hangs freely within the pocket; and a front pocket panel in which a bottom portion of the slit section is attached to a top portion of the front pocket panel, wherein the left, right and bottom portions of the front pocket panel are attached to the front moisture resistant panel to form another pocket.

8. A garment comprising:

a garment material;

a body section that is made of the garment material and covers a body;

at least one limb section that is made of the garment material and covers a limb of the body;

a pocket section that is located at either the body section and the at least one limb section; wherein the pocket section includes a slit section on the garment material, wherein a top portion of the slit section is attached to a top portion of a microfiber drying panel;

a front moisture resistant panel and a rear moisture resistant panel in which the top portion of the slit section is attached to a top portion of the rear moisture resistant panel, wherein the left, right and bottom portions of the rear and front moisture resistant panels are attached to form a pocket, wherein the microfiber drying panel is positioned between the rear and front moisture resistant panels and hangs freely within the pocket; wherein a top portion of the front moisture resistant panel is attached with an elastic band.

9. The garment as defined in claim 1, wherein the front moisture resistant panel is made of stretchable material.

10. The garment as defined in claim 1, wherein the microfiber drying panel is made of absorbent split microfiber towel material.

11. The garment as defined in claim 1, wherein the microfiber drying panel is made of antimicrobial micro-fiber towel material or coated with antimicrobial materials.

12. A towel pocket on a garment comprising:

a slit section on a garment material;

a microfiber drying panel in which a top portion of the slit section is attached to a top portion of the microfiber drying panel; and another microfiber drying panel in which a bottom portion of the slit section is attached to a top portion of the another microfiber drying panel, wherein the left, right and bottom portions of the microfiber drying panels are attached to form a pocket.

13. The towel pocket as defined in claim 12, further comprising a front moisture resistant panel and a rear moisture resistant panel in which the top portion and a bottom portion of the slit section are attached to respective top portions of the rear and front moisture resistant panels, wherein the left, right and bottom portions of the rear and front moisture resistant panels are attached to form a pocket, wherein the microfiber drying panel are positioned between the rear and front moisture resistant panels and hangs freely within the pocket.

14. The towel pocket as defined in claim 12, further comprising a front moisture resistant panel and a rear moisture resistant panel in which the top portion of the slit section is attached to a top portion of the rear moisture resistant panel, wherein the left, right and bottom portions of the rear and front moisture resistant panels are attached to form a pocket, wherein the microfiber drying panel are positioned between the rear and front moisture resistant panels and hangs freely within the pocket.

15. A towel pocket on a garment comprising:

a slit section on a garment material; and a microfiber drying panel in which a top portion of the slit section is attached to a top portion of the microfiber drying panel;

a front moisture resistant panel and a rear moisture resistant panel in which the top portion of the slit section is attached to a top portion of the rear moisture resistant panel, wherein the left, right and bottom portions of the rear and front moisture resistant panels are attached to form a pocket, wherein the microfiber drying panel are positioned between the rear and front moisture resistant panels and hangs freely within the pocket; and a front pocket panel in which a bottom portion of the slit section is attached to a top portion of the front pocket panel, wherein the left, right and bottom portions of the front pocket panel are attached to the front moisture resistant panel to the form another pocket.

16. A towel pocket on a garment comprising:

a slit section on a garment material; and a microfiber drying panel in which a top portion of the slit section is attached to a top portion of the microfiber drying panel;

a front moisture resistant panel and a rear moisture resistant panel in which the top portion of the slit section is attached to a top portion of the rear moisture resistant panel, wherein the left, right and bottom portions of the rear and front moisture resistant panels are attached to form a pocket, wherein the microfiber drying panel are positioned between the rear and front moisture resistant panels and hangs freely within the pocket, wherein a top portion of the front moisture resistant panel is attached with an elastic band.

* * * * *